US005941536A

United States Patent [19]

Hill

[11] Patent Number: 5,941,536

[45] Date of Patent: Aug. 24, 1999

[54] ELASTOMER SEAL FOR ADJUSTABLE SIDE LINERS OF PUMPS

[75] Inventor: Thomas G. Hill, Salt Lake City, Utah

[73] Assignee: EnviroTech Pumpsystems, Inc., Salt Lake City, Utah

[21] Appl. No.: 09/022,690

[22] Filed: Feb. 12, 1998

[51] Int. Cl.[6] ..... F16J 3/00; F16J 15/02; F01D 5/20

[52] U.S. Cl. ..... 277/634; 277/644; 277/637; 415/173.1; 415/196

[58] Field of Search ..... 415/173.2, 174.1, 415/173.1, 196, 197; 277/634, 637, 644, 648, 922

[56] References Cited

U.S. PATENT DOCUMENTS

| | | | |
|---|---|---|---|
| 2,365,058 | 12/1944 | Crawford | 415/197 |
| 3,094,075 | 9/1963 | Logue | 415/197 X |
| 3,146,722 | 9/1964 | Warman | 415/197 X |
| 4,152,096 | 5/1979 | Murakami et al. | 415/200 |
| 4,521,151 | 6/1985 | Frater et al. | 415/174.1 X |
| 4,524,677 | 6/1985 | Ashman et al. | 277/634 X |
| 4,624,465 | 11/1986 | Rogemont | 277/648 X |
| 4,666,166 | 5/1987 | Hart et al. | 277/634 |
| 5,029,878 | 7/1991 | Ray | 277/643 |
| 5,172,793 | 12/1992 | Temple et al. | 277/634 X |
| 5,458,344 | 10/1995 | Weiler et al. | 277/634 |
| 5,513,954 | 5/1996 | Bourgeois | 415/197 |

FOREIGN PATENT DOCUMENTS

| | | | |
|---|---|---|---|
| 966247 | 10/1982 | U.S.S.R. | 415/173.2 |

*Primary Examiner*—James R. Brittain
*Assistant Examiner*—Gary Grafel
*Attorney, Agent, or Firm*—Morriss Bateman O'Bryant & Compagni

[57] ABSTRACT

An elastomer seal member for use in a pump having adjustable side liners is structured with a bellows-type flange which provides and maintains a tight seal between adjoining casing elements of the pump as the side liners are axially adjusted to compensate for wear and abrasion of the side liners. The elastomer seal member provides a continuous seal between adjoining casing elements as the side liners are axially adjusted, thereby extending the service life of the side liners and extending the number of hours the pump may be operated before a replacement of the side liners and seal is required.

14 Claims, 5 Drawing Sheets

ELASTOMER SEAL FOR ADJUSTABLE SIDE LINERS OF PUMPS

BACKGROUND OF THE INVENTION

1. Field of the Invention

This invention relates to slurry pumps used for processing fluids containing abrasive particles, and specifically relates to adjustable elastomer seals for use in slurry pumps having adjustable side liners.

2. Description of Related Art

Slurry pumps are used in industrial applications to transport fluids which often contain abrasive materials or particles, such as slurries produced in mining operations. As such, slurry pumps are subjected to a great deal of wear over time due to the abrasiveness of the fluid being pumped. Additionally, the abrasive fluid can seep into joints between the pump casing elements where the abrasive particles cause further wear, damage and eventual leakage of fluid from the pump casing. The casing elements vary with the configuration and type of pump, but the casing elements usually include a volute shell or casing which is bolted to end bells or frames, or to outer casing halves corresponding to a suction side and drive side of the pump.

It is known to construct slurry pumps with one or more elastomer sealing elements in or along the casing joints to prevent abrasive fluid from seeping into the joints. Examples of such elastomeric sealing elements are disclosed in U.S. Pat. No. 5,029,878 to Ray, U.S. Pat. No. 5,513,954 to Bourgeois, and U.S. Pat. No. 4,152,096 to Murakami, et al. Some elastomer seals function like a gasket to seal the joints between pump casing halves, as exemplified by the disclosure of U.S. Pat. No. 4,152,096. Such seals have an area or surface of elastomer which is exposed to the interior of the pump casing where it is subjected to the abrasive fluid. In time, the abrasiveness of the fluid degrades the seal and it can no longer provide a tight seal between the casing halves. In such cases, the pump casing may begin to leak fluid.

Other pump configurations have been developed where a side liner, or wear plate, is placed in juxtaposition with the impeller of the pump. The side liners, usually corresponding to a suction side and a drive side, are positioned to abut the volute shell or pump casing and, in some configurations, may be bolted to the volute shell or casing. The side liners may be metal, or may be made of elastomer material, and provide a simplified construction for repair or maintenance of the pump. U.S. Pat. No. 5,029,878 discloses an elastomer seal which is configured to be positioned between the side liner and volute casing of the pump to prevent leakage of fluid therebetween. U.S. Pat. No. 5,513,954 discloses an elastomer seal which is configured to essentially line the interior of the pump, and is made of an abrasion-resistant material.

The elastomer seals previously described are useful, but have a finite utility defined by the degree to which the seal is exposed to the abrasive slurries being processed. That is, when the exposed surface or surfaces of the elastomer seal have been abraded and worn, the seal must be replaced. Replacing the seal can not only be expensive and time consuming, but requires that the pump be taken off-line for servicing and repair, which limits the operation time of the pump. The service life of side liners, or the associated elastomer seal, have been extended to some degree by the development of slurry pumps with axially-adjustable side liners which can be adjusted toward the interior of the pump as the side liners become worn and abraded. Even so, the elastomer seals presently employed in such pumps are limited in how far they are capable of moving with the side liner.

Thus, it would be advantageous to provide an elastomer seal member for adjustable side liner pumps which are designed to be adjustable with movement of the side liners so that as the side liners of the pump are adjusted to compensate for wear from exposure to abrasive fluids, the elastomer seal member maintains a tight seal between the pump casing elements, thus extending the service life of the seal and extending the operation of the pump.

BRIEF SUMMARY OF THE INVENTION

In accordance with the present invention, an adjustable elastomer seal member is configured with a bellows-type flange which maintains a complete seal between adjoining casing elements of a pump, and is associated with the axially-adjustable side liners of a pump which are adjustable to compensate for wear in the pump. The adjustable elastomer seal member of the present invention extends the service life of the side liner and extends the operating hours of the pump. The elastomer seal member of the present invention may be adapted for use in any industrial pump having one or more axially-adjustable side liners, but is described herein in connection with a slurry pump by way of example only.

The adjustable elastomer seal member of the present invention is configured with an annular portion, which is associated with an axially-adjustable side liner of a pump, and a bellows-type flange, which extends between adjacent or abutting surfaces of separate casing elements to provide a complete seal therebetween. Side liners of a slurry pump are annular structures which are positioned in parallel orientation to each other and are spaced apart to form the interior space within which the impeller of the pump rotates. The side liners are positioned perpendicularly to the volute of the pump and have an interior surface which is maintained in close proximity to the outer edges of the impeller blades as the impeller rotates. Thus, as the impeller rotates within the interior of the pump, centrifugal force moves the fluid to the volute where a fluid ring is formed, and the close proximity of the rotating impeller blades to the interior surface of the side liners functions to limit abrasive fluid from migrating toward the central axis of the pump.

In slurry pumps with adjustable side liners, the side liners are movably attached to the ends of the pump casing so that the side liners can be axially adjusted toward each other. As abrasive fluid migrates between the impeller vanes and the side liners, both the impeller vanes and the interior surface of the side liners begin to wear and a larger gap forms, thereby leading to potentially greater damage and leakage. Therefore, as the side liners and impeller become abraded and worn, the side liners can be axially adjusted toward each other and, thus, toward the impeller, to bring the interior surface of the side liners into close proximity with the impeller vanes again.

In the present invention, the annular portion of the elastomer seal member may, in some embodiments, be secured to the side liner or, in an alternative embodiment, the annular portion may be integrally formed with the side liner of the pump. The side liners may be made of metal or may preferably be made of an elastomer material of high durometer. The annular portion of the elastomer seal member may also be secured to, or integrally formed with, an annular reinforcement plate which is positioned between the side liner and the end casing element of the pump. The annular reinforcement plate is attached to the end casing element in a manner which allows the annular reinforcement plate to be axially adjusted relative to the end casing element.

The annular portion of the elastomer seal member is positioned between the adjustable side liner and some element of the pump casing, usually the volute shell or casing liner, to provide a fluid tight seal therebetween. The annular portion may include one or more elastomer ribs which extend outwardly from the annular portion to contact the abutting surface of the adjacent casing element. The elastomer rib or ribs provide an additional area of contact between the side liner and adjacent casing element so that as the side liner is adjusted axially, and the elastomer seal member moves relative to the stationary casing element, a tight seal is maintained at the joint.

The adjustable elastomer seal member of the present invention also includes a bellows-type flange which extends outwardly to be positioned between adjacent casing elements of the pump casing, such as between the volute shell and the end bell of the pump. The bellows-type flange provides a tight seal between the adjoining casing elements to prevent fluid from entering between the casing elements. The bellows-type flange is oriented relative to the annular portion of the elastomer seal so that the seal between the casing elements provided by the bellows-type flange is maintained as the annular portion moves with the axial adjustment of the side liner. As a result, the elastomer seal of the adjustable side liner effectively extends the service life of the adjustable side liner and allows the pump to be operated for a longer period of time before repairs or replacement of the side liner need to be made. These and other advantages of the present invention will be more apparent with reference to the description of the accompanying drawings.

BRIEF DESCRIPTION OF THE SEVERAL VIEWS OF THE DRAWINGS

In the drawings, which illustrate what is currently considered to be the best mode of carrying out the invention.

DETAILED DESCRIPTION OF THE INVENTION

Figure 1:
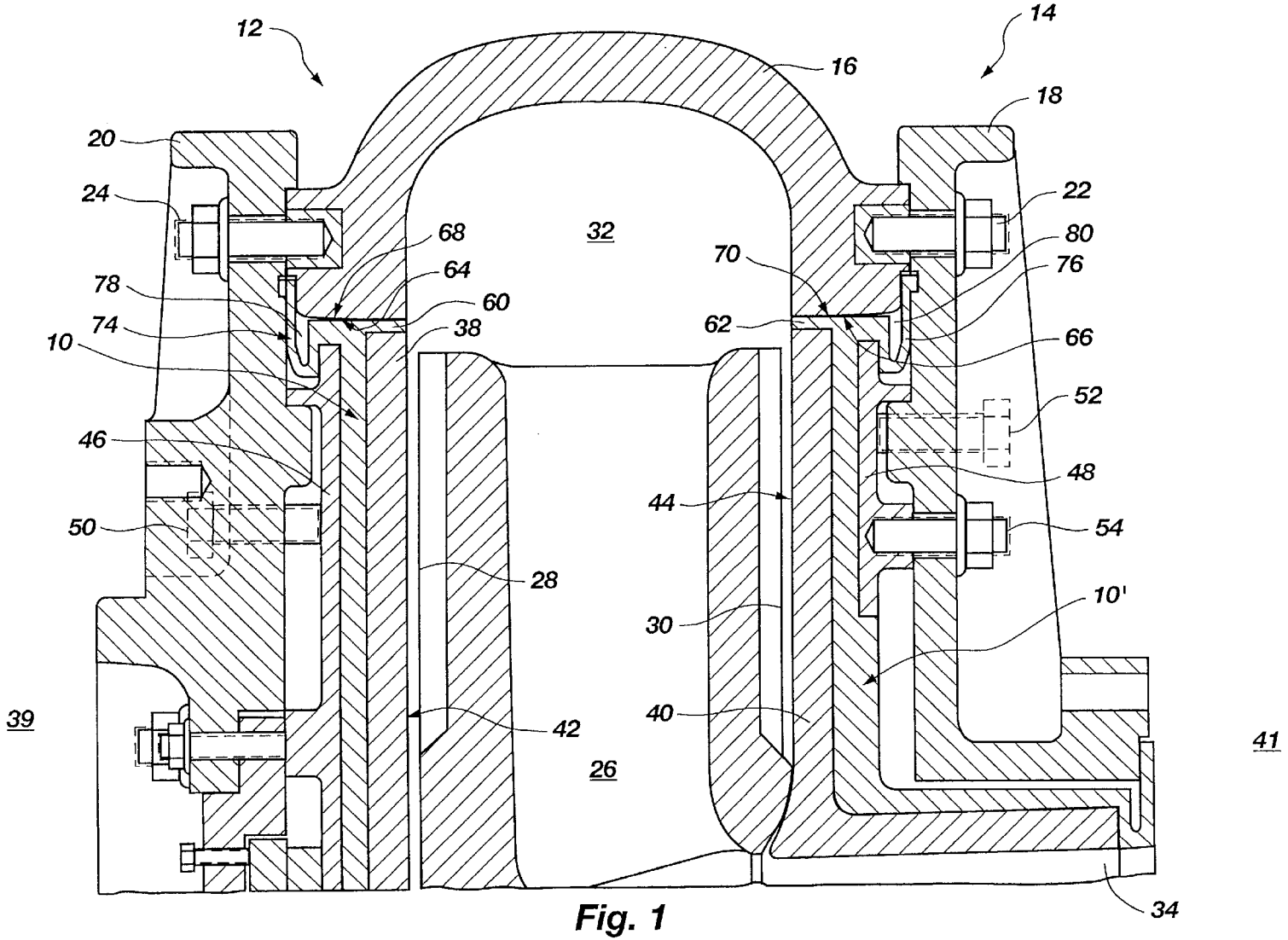
FIG. 1 is a view in cross section of a portion of a slurry pump illustrating a first embodiment of the elastomer seal member of the invention.

FIG. 1 illustrates a first embodiment of the elastomer seal member 10 of the present invention employed in a slurry pump 12. The slurry pump 12, only one half of which is shown, has an outer pump casing 14 which, in this illustrated configuration, comprises a volute shell 16 connected to a suction side end bell 18 and to a drive side end bell 20 by means of a plurality of bolts 22, 24. An impeller 26, having outwardly extending expeller vane edges 28, 30, is positioned in the interior 32 of the pump 12 where it encounters fluid entering the pump 12 through the pump inlet 34. The pump 12 illustrated in FIG. 1 is one which has adjustable side liners 38, 40 which are positioned in parallel orientation to the drive side end bell 20 and suction side end bell 18 to which each is attached, respectively. The side liner 38 which is positioned on the drive side 39 of the pump 12 encircles the drive shaft or rotor (not shown) to which the impeller 26 is attached. The side liner 40 on the suction side 41 of the pump 12 encircles the pump inlet 34.

The side liners 38, 40 each have an interior facing surface 42, 44, respectively, which is positioned adjacent to and in close proximity to the expeller vane edges 28, 30 of the impeller 26 such that as the impeller rotates, only a very small gap exists therebetween. Maintaining a close tolerance between the side liners 38, 40 and the expeller vane edges 28, 30 of the impeller 26 reduces the amount of abrasive fluid that may migrate toward the central axis of the pump 12 during operation. The "central axis," as used herein, refers to a longitudinal axis which extends through the drive shaft of the pump 12.

Each side liner 38, 40 has associated therewith an elastomer seal member 10, 10' of the invention. The elastomer seal member 10, 10' may be positioned against a reinforcement plate 46, 48 which is positioned in parallel alignment with the side liner 38, 40 with which each is respectively associated and, as shown, the elastomer seal member 10, 10' may include a portion which is sandwiched between the reinforcement plate 46, 48 and the side liner 38, 40. By virtue of their interaction as a unit, and by virtue of the manner in which the reinforcement plate, elastomer seal member and side liner may be formed, the three elements together may be considered and referred to as a side liner assembly.

In the embodiment of the invention shown in FIG. 1, the side liner assembly on the drive side 39 of the pump 12 is formed by placing the side liner 38, which may preferably be metal, into the bottom of a mold, followed by placement into the mold of a suitable elastomer material. The reinforcement plate 46 is then positioned in the mold on top of the elastomer material. Pressure is then applied to form the elastomer seal member 10 in the desired configuration, to bond the reinforcement plate 46 to the elastomer seal member 10 and to form the elastomer seal member 10 in the side liner 38. Alternatively, the elastomer seal member 10 may be pre-molded in the desired configuration and thereafter attached to the reinforcement plate 46 and side liner 38 by any suitable method, including adhesive bonding. The side liner assembly on the suction side 41 may be made in any similar manner as described for side liner assembly on the drive side.

The reinforcement plate 46, 48 of each side liner assembly is attached to the respective end bell 20, 18 with which it is associated by means of a plurality of bolts 50, 52, 54 positioned through the respective end bell 20, 18. Some of the bolts used to attach the reinforcement plate 46, 48 to respective end bell 20, 18 are pusher bolts 50, 52 which, when tightened, axially move the side liner assembly toward the impeller 26. In so doing, the interior surface 42, 44 of the respective side liner assemblies can be brought into closer proximity with the impeller expeller vane edges 28, 30 as the interior surface 42, 44 of the side liners 38, 40 and the edges 28, 30 of the impeller expeller vanes become abraded and worn.

Figure 2:
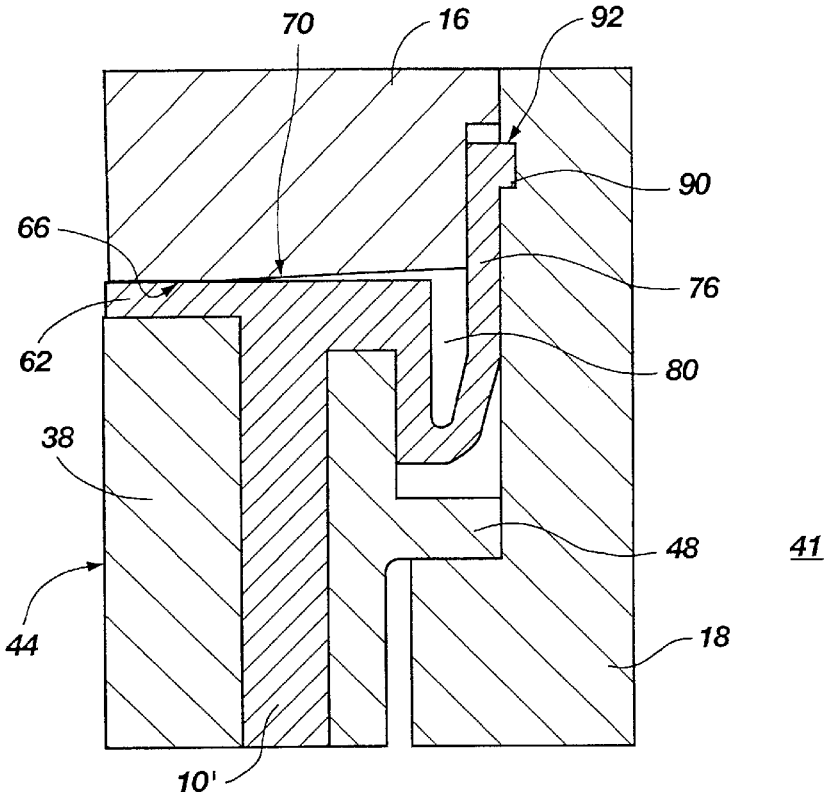
FIG. 2 is an enlarged view in cross section of the bellows-type flange of the elastomer seal member shown in FIG. 1.
Figure 3:
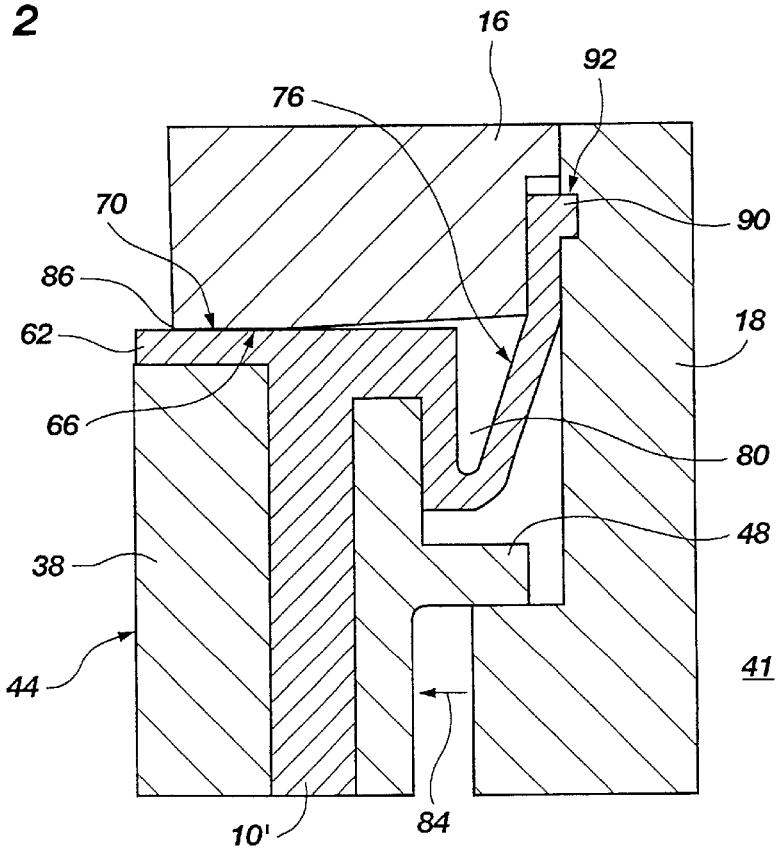
FIG. 3 is an enlarged view in cross section of the bellows-type flange of the elastomer seal member shown in FIG. 2 illustrating the expandability of the elastomer seal member with axial movement of the side liner.

The elastomer seal member 10, 10' of the present invention, as shown in FIGS. 1–3, comprises an annular portion 60, 62 in alignment with the side liner 38, 40, respectively. Each annular portion 60, 62 has a contact surface 64, 66 which is positioned to engage a portion of the pump casing 14. In this configuration of the pump 12 and elastomer seal member 10, 10', the contact surface 64, 66 of each elastomer seal member 10, 10' is positioned to contact the lateral edge 68, 70 of the volute shell 16. Thus, the annular portion 60, 62 sealingly engages the lateral edges 68, 70 of the volute shell 16 to form a seal between the side liner 38, 40 and the volute shell 16.

The elastomer seal member 10, 10' of the present invention is also configured with a bellows-type flange 74, 76 which extends from the annular portion 60, 62 and is oriented to be positioned between adjoining pump casing elements to provide a tight seal. In the illustrated configuration of the pump 12 and elastomer seal member 10, 10', the bellow-stype flange 74, 76 is positioned between the volute shell 16 and the respective drive side end bell 20 and suction side end bell 18 to which the volute shell 16 is secured. The bellows-type flange 74, 76 extends from the annular portion 60, 62 in a manner which allows the bellows-type flange 74, 76 to remain positioned between the adjoining casing elements as the side liner assembly is axially adjusted. Thus, as shown, the elastomer seal member 10, 10' may be configured with an expandable space 78, 80 between the annular portion 60, 62 and the bellows-type flange 74, 76.

As shown more clearly in FIGS. 2 and 3, which illustrate only the suction side 41 of the pump 12, the bellows-type flange 76 is positioned between the suction side end bell 18 and the volute shell 16 to form a seal therebetween. The elastomer seal member 10' is configured with an expandable space 80 adjacent the bellows-type flange 76. FIG. 2 illustrates the relative positioning of the side liner 38, elastomer seal member 10' and reinforcement plate 48 when the pump is first constructed and operated. As the pump operates, however, and the interior facing surface 44 of the side liner 38 becomes abraded and worn, the side liner assembly is axially-adjusted, in the direction of arrow 84 shown in FIG. 3, to bring the interior surface 44 of the side liner 38 into closer proximity to the expeller vane edge 30 of the impeller 26 (not shown in FIG. 3). As the side liner assembly is axially adjusted, the expandable space 80 widens, thereby allowing the bellows-type flange 76 to maintain the seal between the volute shell 16 and the end bell 18. As the side liner assembly is axially adjusted, a seal is substantially maintained between the contact surface 66 of the annular portion 62 and the lateral surface 70 of the volute shell 16. It can be seen, however, that an amount of the side liner assembly at the joint 86 between the volute shell 16 and side liner 38 becomes potentially exposed to abrasive fluid and will wear down over time. The side liner assembly may continue to be advanced as the interior facing surface 44 of the side liner assembly degrades.

The bellows-type flange 76 may, as shown in FIGS. 1–3, have one (or more than one) annular lip 90 to assure that the bellows-type flange 76 remains positioned between the casing elements as the annular portion 62 is moved axially. The annular lip 90 may be sized to be received within a similarly shaped and positioned groove 92 formed in the end bell 18 to further assure that the bellows-type flange 76 remains in place during movement of the side liner assembly.

Figure 4:
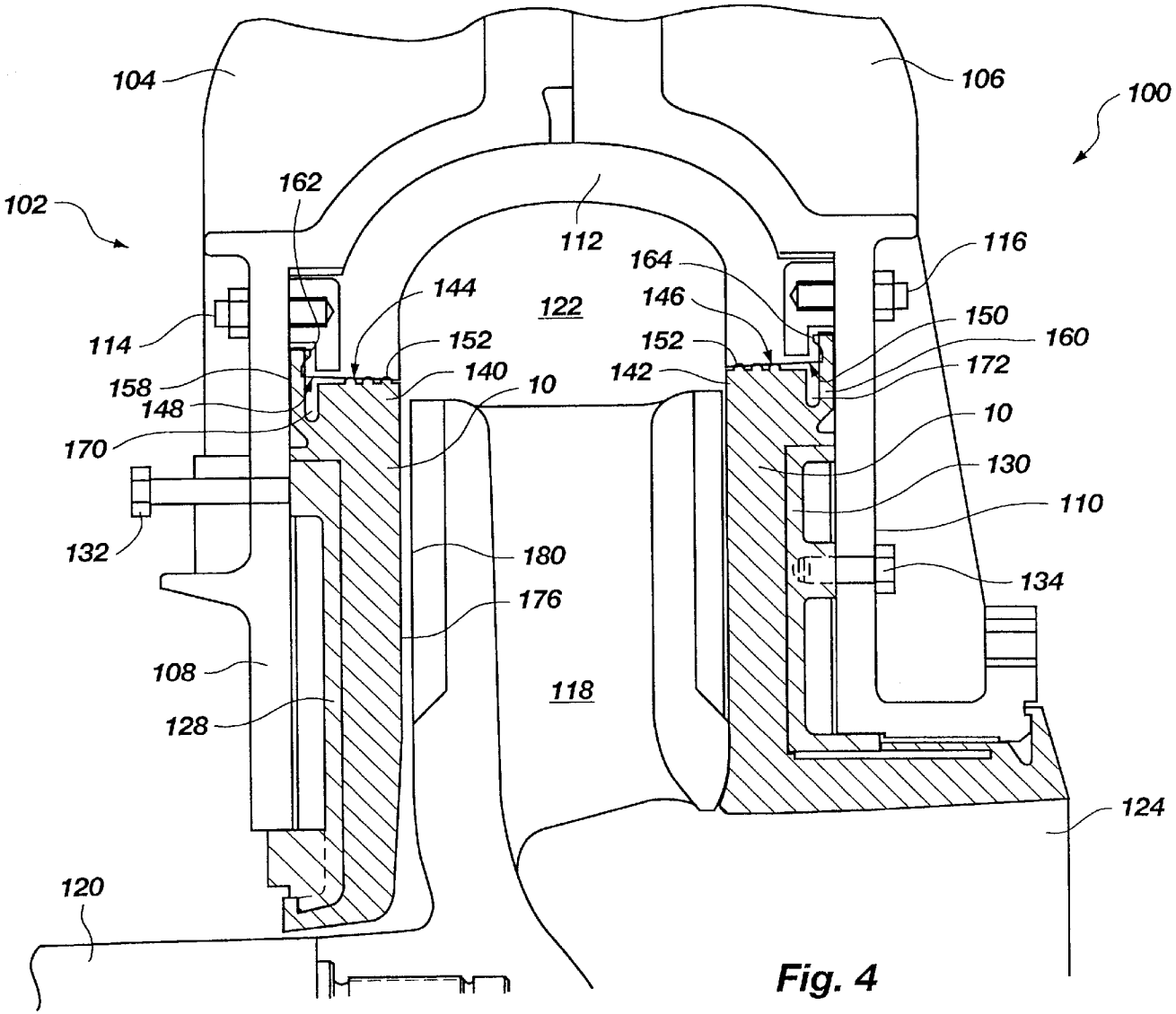
FIG. 4 is a view in cross section of a portion of a differently configured slurry pump, and illustrating an alternative embodiment of the elastomer seal member of the invention.

An alternative embodiment of the elastomer seal member 10, 10' of the invention is illustrated in FIGS. 4–7, which also illustrate a variation in the pump casing elements compared to those illustrated and described previously. In FIG. 4, the pump 100, only half of which is shown, has an outer pump casing 102 comprising a drive side volute casing 104 and a suction side volute casing 106. Both the drive side volute casing 104 and the suction side volute casing 106 are integrally formed with end plates 108, 110. The pump casing 102 also includes a metal volute shell or, as shown, a rubber volute casing liner 112 which is secured along one side to the drive side volute casing 104 by a plurality of bolts 114, and is secured along the other side to the suction side volute casing 106 by a plurality of bolts 116. An impeller 118, attached to a rotor and drive shaft 120, is positioned within the interior 122 of the pump 100 to move fluid which enters the interior 122 by way of the pump inlet 124.

In the embodiment shown in FIG. 4, the side liner and elastomer seal member 10, 10' are integrally formed as part of the side liner assembly. The elastomer seal member 10, 10' may also be attached to a reinforcement plate 128, 130, respectively, which is secured to the end plate 108, 110 of the drive side volute casing 104 or suction side volute casing 106, respectively. The reinforcement plate 128, 130 may be integrally formed to the elastomer seal member 10, 10' by a high temperature, high pressure process, or the reinforcement plate 128, 130 may be attached to the respective elastomer seal member 10, 10' by suitable bonding methods, such as adhesive. Each reinforcement plate 128, 130 is attached to its respective end plate 108, 110 by a plurality of bolts 132, 134, some of which are pusher bolts 132 which can be adjusted to cause the reinforcement plate 108, 110 and elastomer seal member 10, 10' to move axially toward the impeller 118.

The elastomer seal member 10, 10' has an annular portion 140, 142 with a contact surface 144, 146 which is positioned to sealingly engage with an element of the pump casing, here shown as the lateral surface 148, 150 of the volute casing liner 112. These elements are shown most clearly in FIG. 5, which illustrates only the drive side portion of the pump 100 and illustrates the volute casing liner 112 spaced from the elastomer seal member 10 as it would be during assembly of the pump casing 102. In other words, the side liner assembly, comprising the reinforcement plate 128 and elastomer seal member 10, is attached to the end plate 108 of the drive side volute casing 104, followed by positioning of the volute casing liner 112 over and about the elastomer seal member 10.

The contact surface 144, 146 of the annular portion 140, 142 may also be configured with one or more elastomer ribs 154 which contact the lateral surface 148, 150 of the volute casing liner 112 and are compressed against the lateral surface 148, 150 to provide a tight seal thereagainst. While the elastomer ribs 152 may vary in number and design, the elastomer rib 152 configuration shown may be particularly suitable since they allow the side liner assembly to be axially adjusted while lessening the friction or resistance experienced between the elastomer ribs 152 and the lateral surface 148, 150 of the volute casing liner 112. Other designs of the elastomer ribs 152 may be equally suitable, however.

Figure 5:
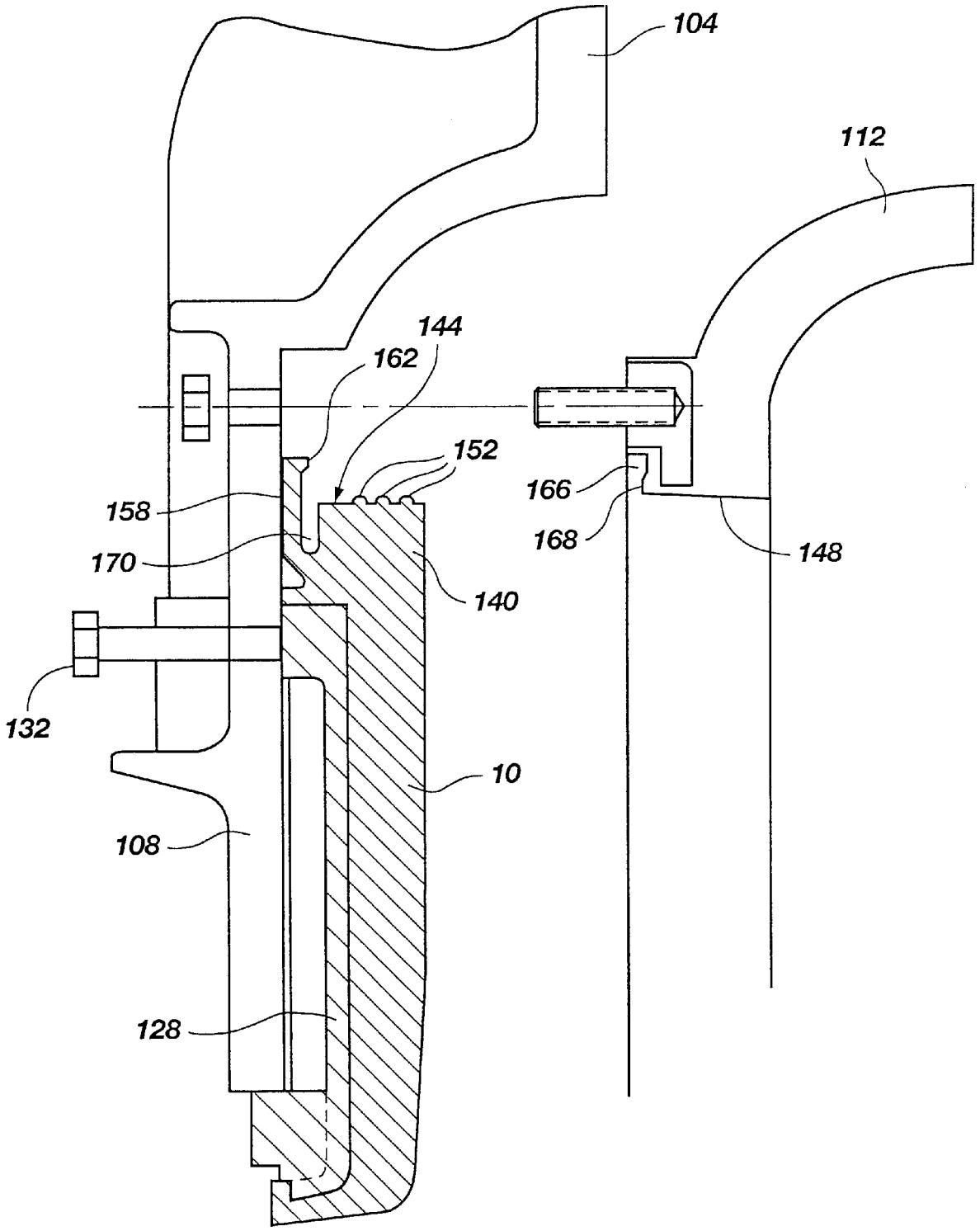
FIG. 5 is an exploded view of the pump casing and elastomer seal member shown in FIG. 4 with the volute casing separated from the elastomer seal member.

The elastomer seal member 10, 10' is also configured with a bellows-type flange 158, 160 which is oriented for positioning between adjoining pump casing elements, here shown as being positioned between the volute casing liner 112 and the drive side volute casing 104 and the suction side volute casing 106, respectively. The bellows-type flange 158, 160 is structured to be retained in position between the volute casings 104, 106 and the volute casing liner 112 and to maintain a seal therebetween as the side liner assembly is axially adjusted. The bellows-type flange 158, 160 may be configured with an extended lip 162, 164 which may be oriented to register with a corresponding groove 166 in the volute casing liner 112, as best seen in FIG. 5. The volute casing liner 112 may also be configured with a raised rim 168 adjacent the groove 166 to provided an additional contact point between the bellows-type flange 158 and the volute casing liner 112, thereby assuring that the bellows-type flange 158 will remain in place between the adjoining casing elements as the side liner assembly is axially adjusted.

Figure 7:
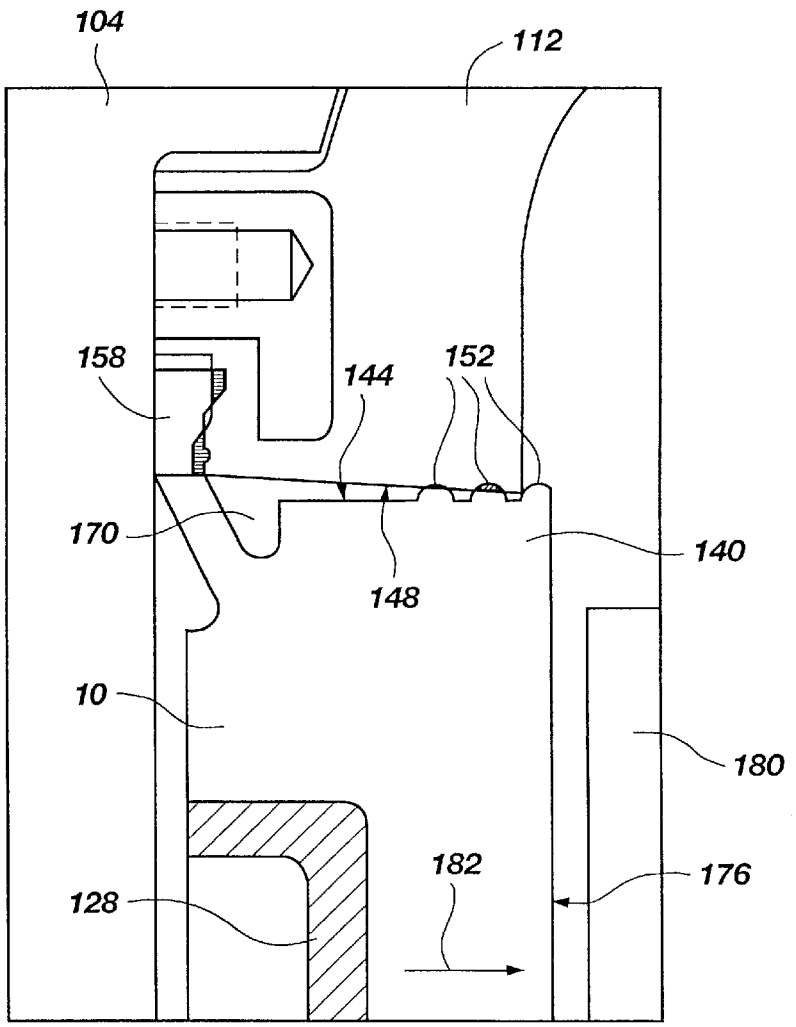
FIG. 7 is an enlarged view in cross section of the bellows-type flange shown in FIG. 6 illustrating the expandability of the elastomer seal member with axial movement of the side liner.
Figure 6:
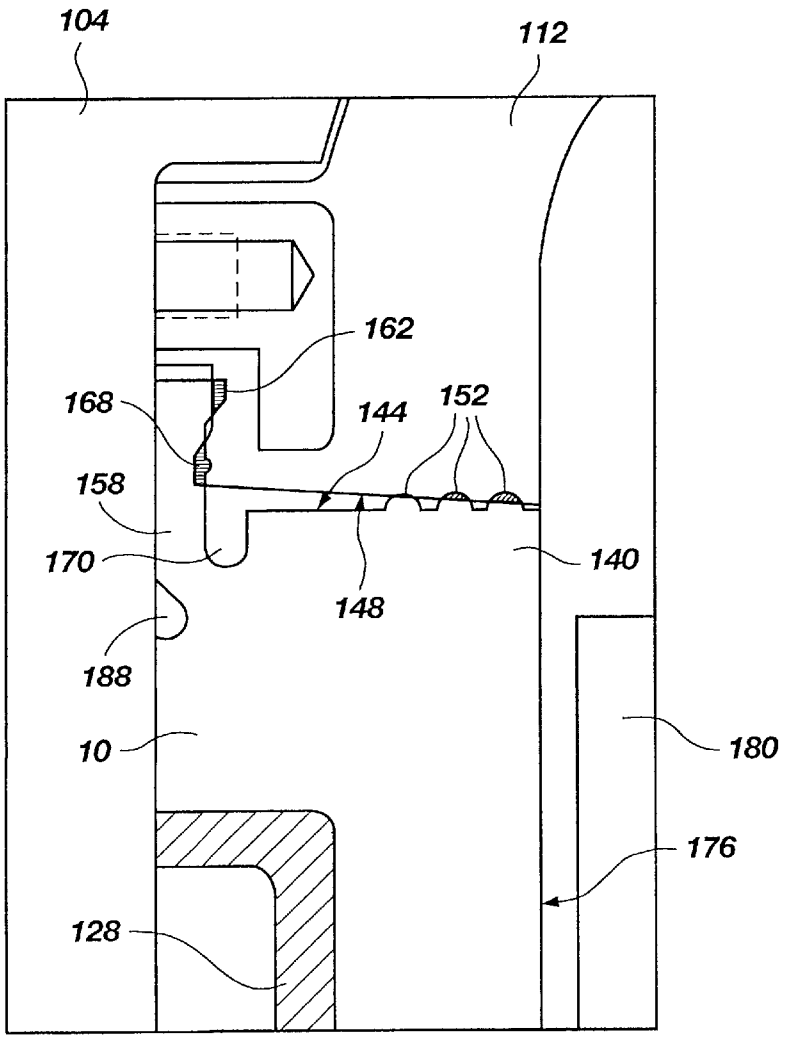
FIG. 6 is an enlarged view in cross section of the bellows-type flange of the elastomer seal member shown in FIG. 4.

The elastomer seal member 10, 10' is configured to allow the bellows-type flange 158, 160 to remain positioned between the casing elements as the annular portion 140, 142 is axially adjusted. Thus, for example, an expandable space 170, 172 may be formed adjacent to the bellows-type flange 158, 160 to permit axial movement of the annular portion 140, 142 while the bellows-type flange 158, 160 remains in position between the casing elements. This principal is best illustrated in FIGS. 6 and 7 which show an enlarged section of the drive side volute casing 104, volute casing liner 112 and elastomer seal member 10. FIG. 6 illustrates the relative positioning of the bellows-type flange 158 and annular portion 140 of the elastomer seal member 10 when the pump is initially assembled. It can be seen that the bellows-type flange 158 is compressed between the volute casing 104 and the volute casing liner 112 to form a tight seal. It can also be seen that the contact surface 144 of the annular portion 140 is registered against the lateral surface 148 of the volute casing liner 112, and that the elastomer ribs 152 are compressed against the lateral surface 148 of the volute casing liner 112 in sealing engagement to form a seal.

As the interior-facing surface 176 of the elastomer seal member 10 becomes abraded and worn as a result of abrasive fluid migrating between the elastomer seal member 10 and the expeller vane 180 of the impeller 118, the side liner assembly is axially adjusted, in the direction of arrow 182 in FIG. 7, so that the gap between the interior-facing surface 176 and the expeller vane 180 of the impeller 118 is reduced to limit the migration of more abrasive fluid therebetween. Thus, as the reinforcement plate 128 and elastomer seal member 10 are moved axially, the elastomer ribs 152 slide along the lateral surface 148 of the volute casing liner 112 while still maintaining a seal. The expandable space 170 allows the annular portion 140 to move axially while the bellows-type flange 158 remains in position between the volute casing 104 and the volute casing liner 112 maintaining a tight seal. As shown in FIG. 6, a notch 188 may be formed in the elastomer seal member 10 in proximity to the expandable space 170 to provide a hinge-type movement of the bellows-type flange 158 as the side liner assembly is axially adjusted.

The elastomer seal member of the present invention is designed to provide a continuous sealing condition between casing elements of a pump as the side liners of the pump are axially adjusted toward the impeller. The elastomer seal member may be adapted to any type of pump, including pumps which do not have adjustable side liners, although the elastomer seal is particularly suitable for such applications. The orientation and positioning of the bellows-type flange, and the employment of other described structures associated with the elastomer seal member, will necessarily vary with different types and configurations of pump casings. Hence, reference herein to specific details of the illustrated embodiments is by way of example and not by way of limitation. It will be apparent to those skilled in the art that many modifications of the basic illustrated embodiments may be made without departing from the spirit and scope of the invention as recited by the claims.

What is claimed is:

1. An elastomer seal member for a pump having adjustable side liners, comprising:

an elastomer body having a disk-shaved portion positionable against the axially adjustable side liner of a pump;

an annular portion positioned about the outer periphery of said disk-shaped portion; and a bellows-type flange extending radially outwardly from said annular portion for positioning between adjacent casing elements of a pump to provide and maintain a seal between the adjacent casing elements, said flange being positioned to be increasingly distanced from said annular portion as said annular portion is axially moved with adjustment of the side liner with which it is aligned.

2. The elastomer seal of claim 1 wherein said bellows-type flange further comprises a raised rim extending outwardly from said bellows-type flange to engage a recessed portion of a casing element of the pump.

3. The elastomer seal of claim 2 further comprising at least one elastomer rib extending outwardly from said annular portion of said elastomer seal member to engage a portion of a casing element of a pump to provide a seal between adjacent surfaces of the casing element and adjustable side liner.

4. The elastomer seal of claim 3 wherein said at least one elastomer rib further comprises a plurality of elastomer ribs extending from said annular portion and positioned in parallel orientation to each other.

5. The elastomer seal of claim 1 further comprising at least one elastomer rib extending outwardly from said annular portion of said elastomer seal member to engage a portion of a casing element of a pump to provide a seal between adjacent surfaces of the casing element and adjustable side liner.

6. The elastomer seal of claim 5 wherein said at least one elastomer rib further comprises a plurality of elastomer ribs extending from said annular portion and positioned in parallel orientation to each other.

7. A fluid pump comprising:

a volute casing element;

a suction side end casing element adjoining said volute casing element;

a drive side end casing element adjoining said volute casing element;

a first axially-adjustable side liner positioned in parallel orientation to said suction side end casing element;

a second axially-adjustable side liner positioned in parallel orientation to said drive side end casing element;

a first adjustable elastomer seal member having an annular portion positioned in alignment with said first axially-adjustable side liner and being axially-adjustable therewith, and having a bellows-type flange positioned between abutting surfaces of said volute casing element and said suction side end casing element to maintain a seal therebetween as said annular portion is axially adjusted; and a second adjustable elastomer seal member having an annular portion positioned in alignment with said second axially-adjustable side liner and being axially-adjustable therewith, and having a bellows-type flange positioned between abutting surfaces of said volute casing element and said drive side end casing element to maintain a seal therebetween as said annular portion of said second adjustable elastomer seal member is axially adjusted.

8. The pump of claim 7 wherein said first adjustable elastomer seal member is integrally formed to said first side liner.

9. The pump of claim 8 wherein said first adjustable elastomer seal member is positioned against an annular reinforcement plate aligned with said suction side end casing element, said annular reinforcement plate being axially adjustable relative to said suction side end casing element.

10. The pump of claim 8 wherein said second adjustable elastomer seal member is integrally formed to said second side liner.

11. The pump of claim 10 wherein said second adjustable elastomer seal member is positioned against an annular reinforcement plate aligned with said drive side end casing element, said annular reinforcement plate being axially adjustable relative to said drive side end casing element.

12. The pump of claim 7 wherein said volute casing element is integrally formed with said suction side end casing element and with said drive side end casing element, and wherein said pump further comprises a volute shell having a first abutting surface for positioning against said bellows-type flange of said first adjustable elastomer seal member and a second abutting surface for positioning against said bellows-type flange of said second adjustable elastomer seal member.

13. The pump of claim 12 wherein each said annular portion of said first adjustable elastomer seal member and said second adjustable elastomer seal member further comprises at least one elastomer rib extending outwardly from said annular portion to engage a surface of said volute shell to provide a seal between adjacent surfaces of said volute shell and each respective axially-adjustable side liner.

14. The pump of claim 7 wherein each said annular portion of said first adjustable elastomer seal member and said second adjustable elastomer seal member further comprises at least one elastomer rib extending outwardly from said annular portion to engage a surface of said volute casing element to provide a seal between adjacent surfaces of said volute casing element and each respective axially-adjustable side liner.

* * * * *